US005270740A

United States Patent [19]

Naruse et al.

[11] Patent Number: 5,270,740

[45] Date of Patent: Dec. 14, 1993

[54] INK JET HEAD

[75] Inventors: Osamu Naruse; Hiromichi Komai, both of Yokohama; Toshio Inada, Sagamihara; Toshitaka Hirata, Tokyo; Kenichi Ichikawa, Machida; Tomoaki Nakano, Yokohama; Minoru Ameyama, Yokohama; Masami Kadonaga, Yokohama; Syuzo Matsumoto, Yokohama; Kouji Izumi, Yokohama, all of Japan

[73] Assignee: Ricoh Company, Ltd., Tokyo, Japan

[21] Appl. No.: 843,458

[22] Filed: Feb. 28, 1992

[30] Foreign Application Priority Data

Mar. 26, 1991 [JP] Japan ..... 3-087756

[51] Int. Cl.[5] ..... B41J 2/045; B41J 2/055; B41J 2/195

[52] U.S. Cl. ..... 346/140 R

[58] Field of Search ..... 346/140 R, 75

[56] References Cited

U.S. PATENT DOCUMENTS

| | | | |
|---|---|---|---|
| 4,390,886 | 6/1983 | Sultan | 346/140 R |
| 4,695,852 | 9/1987 | Scardovi | 346/140 R |

FOREIGN PATENT DOCUMENTS

| | | | |
|---|---|---|---|
| 0063273 | 5/1980 | Japan | 346/140 R |
| 58-30824 | 7/1983 | Japan . | |
| 59-5570 | 2/1984 | Japan . | |
| 60-90770 | 5/1985 | Japan . | |
| 62-56150 | 3/1987 | Japan . | |
| 0073348 | 3/1991 | Japan . | |
| 0162962 | 7/1991 | Japan . | |

*Primary Examiner*—Benjamin R. Fuller
*Assistant Examiner*—Alrick Bobb
*Attorney, Agent, or Firm*—Cooper & Dunham

[57] ABSTRACT

An ink jet head used for pulsed droplet ink jet printer uses a grooved piezo-electric element. The piezo-electric element includes a plurality of grooves, diaphrams and actuators. The actuator and two grooves at both sides of the actuator, filled with stuffing material, covers a corresponding one of passages. Therefore, even if the stuffing material moves when the actuator is energized, an interference problem does not occur. Consequently, the flexure force of each actuator can transmit to the corresponding passage to jet ink in the passage via a nozzle.

8 Claims, 5 Drawing Sheets

INK JET HEAD

BACKGROUND OF THE INVENTION

The present invention relates generally to ink jet heads used for pulsed droplet ink jet printers, often also referred to as drop-on-demand ink jet printers.

U.S. patent application Ser. No. 522,328, and Japanese Laid-Open Patent Applications No.60-90770 and No.62-56150 respectively disclose compact ink jet heads.

The ink jet head disclosed in U.S. patent application Ser. No. 522,328, proposed by this applicant, comprises, as shown in FIG. 1A, a passage plate 21, nozzles 23, a piezo-electric element 24, and stuffing material 25. The passage plate 21 is grooved to form passages 22 to which pressured ink is supplied, whereas the piezo-electric element 24 is grooved, so that adjacent operating parts (referred to as actuators hereinafter) thereof cannot come into contact with each other. Each nozzle 23 is attached to an outlet of each passage 22. Each groove in the piezo-electric element 24 is filled with the stuffing material 25 to prevent pressured ink from leaking into it. Each actuator is not flexed while not energized, as shown in FIG. 1A, whereas it is flexed, while energized, as shown in FIG. 1B, to generate a pulse each of the respective passages 22. Due to the flexure of the actuator, ink in the passage 22 is jetted via the nozzle 23. However, since each actuator heaves the adjacent stuffing material 25 and moves the passage plate 21 upwardly, as shown in FIG. 1B, the flexure force of the actuator does not sufficiently transmit to the passage 22 and thus sufficient ink is not jetted from the nozzle 23. This tendency becomes noticeable as a plurality of actuators are simultaneously energized.

The ink jet head disclosed in Japanese Laid-Open Patent Application No.60-90770 uses a piezo-electric strain constant with respect to a direction in which a piezo-electric element is polarized. The actuators are coupled to each other via a plate. However, due to the plate, this ink jet head has a disadvantage in that adjacent actuators interfere with each other during flexure thereof. The ink jet head disclosed in Japanese Laid-Open Patent Application No.62-56150 comprises a piezo-electric element having deep grooves and shallow grooves, and a passage plate which is not grooved. However, this ink jet head has a disadvantage in that it is difficult to form the deep and shallow grooves in piezo-electric element.

On the other hand, Japanese Laid-Open Utility Model Publications No.59-5570 and No. 58-30824 are directed toward the problem of bubbles in the passage. If the passage includes bubbles or does not include sufficient ink, sufficient ink cannot be jetted from the nozzle. In addition to not being able to completely print out all input data, the printer using the head cannot indicate the above condition as being an error. Accordingly, Japanese Utility Model Publication No.59-5570 discloses an ink jet head in which bubbles and insufficient ink in the passage can be detected. Japanese Utility Model Publication No. 58-30824 discloses an ink jet head in which bubbles in the passage can be removed. However, bubbles must be detected in each nozzle in a multinozzle head since each nozzle affects the image quality, and in a color printer, a number, defined by (four colors)*(the number of nozzles), of detecting circuits is needed, which makes the printer expensive. Moreover, since the conventional detecting circuit are located at the actuator to detect bubbles by means of a change in driving voltage, the detecting sensitivity is so bad that the detecting circuits can detect only a large amount of bubbles.

SUMMARY OF THE INVENTION

Accordingly, it is a general object of the present invention to provide a novel and useful ink jet head in which the above disadvantages are eliminated.

Another more specific object of the present invention is to provide a compact ink jet head in which actuators do not interfere with each other.

Still another object of the present invention is to provide an ink jet head in which bubbles in a passage can be precisely detected by a number of detecting circuits less than that needed for the conventional ink jet head.

According to one feature of the present invention, An ink jet head comprises a piezo-electric element including a plurality of actuators, first diaphrams, and first grooves, the actuators and the first diaphrams being convex parts of the piezo-electric element, a passage plate including a plurality of second diaphrams and second grooves, the second diaphrams being convex parts of the passage plate and connected to the first diaphrams, and ink being supplied to each of second grooves, stuffing material, with which each of the first grooves of the piezo-electric element is filled, each of the second grooves being covered with one actuator and stuffing material in two first grooves at both sides of the one actuator, a plurality of nozzles, one of which is attached to each corresponding one of the second grooves, and energizing means for energizing the actuators of the piezo-electric element, each of the actuators being flexed when energized by the enrgizing means so as to press a corresponding one of the second grooves and jet the ink via a corresponding one of the nozzles.

According to another feature of the present invention, an ink jet head comprises a piezo-electric element including a plurality of actuators, first diaphrams, and first grooves, the actuators and the first diaphrams being convex parts of the piezo-electric element, a passage plate including a plurality of second diaphrams and second grooves, the second diaphrams being convex parts of the passage plate and connected to the first diaphrams, and ink being supplied to each of second grooves, a film member, located between the piezo-electric element and the passage plate, each of the second grooves being directly opposite, via the film member, to one actuator and stuffing material in two first grooves at both sides of the one actuator, a plurality of nozzles, one of which is attached to each corresponding one of the second grooves, and energizing means for energizing the actuators of the piezo-electric element, each of the actuators of the piezo-electric element being flexed when energized by the enrgizing means so as to press a corresponding one of the second grooves via the film member and jet the ink therein via a corresponding one of the nozzles.

According to one aspect of the present invention, due to the first groove located below the second groove, which is a passage, and a pair of diaphrams, the stuffing material does not move the passage plate even when the actuator is energized. According to another aspect of the present invention, the film material supercedes the stuffing material.

Other objects and further features of the present invention will become apparent from the following detailed description when read in conjunction with the accompanying drawings.

DETAILED DESCRIPTION OF THE PREFERRED EMBODIMENTS

Figure 2:
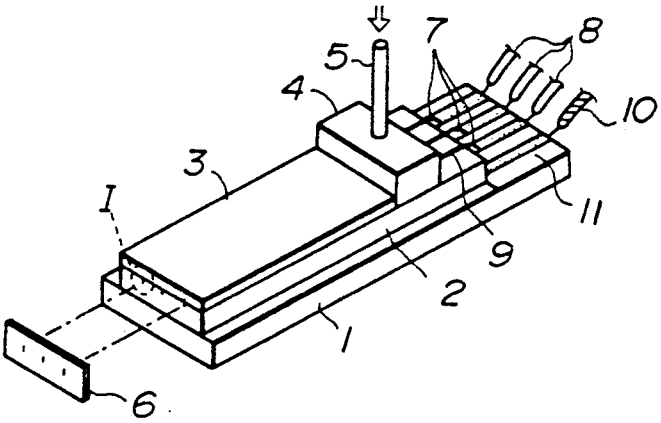
FIG. 2 PRIOR ART
FIG. 2 shows an exterior perspective view of a general ink jet head.

A general ink jet head comprises, as shown in FIG. 2, a base 1, a piezo-electric element 2, a passage plate 3, a (pressured) liquid room 4, an ink supply pipe 5, a nozzle plate 6, copper wires 7, lead wires 8, electrodes 9, a grounded lead wire 10, and a wire plate 11. Ink supplied via the ink supply pipe 5 is stored in the liquid room 4, and fed to passages provided on the passage plate 3. The nozzle plate 6 has a plurality of nozzles attached to outlets of the respective passages. The piezo-electric element 2 flexes when it is energized via the electrodes 9. The copper wires 7, lead wires 8, grounded lead wire 10, and wire plate 11 are used to drive the piezo-electric element 2. When the piezo-electric element 2 flexes, it presses the passages and ink in the passages is jetted via nozzles.

Figure 1A:
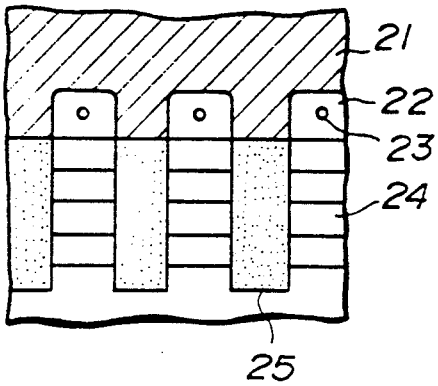
FIG. 1A PRIOR ART
FIG. 1A shows an enlarged view of a part of a conventional ink jet head which is not energized.
Figure 1B:
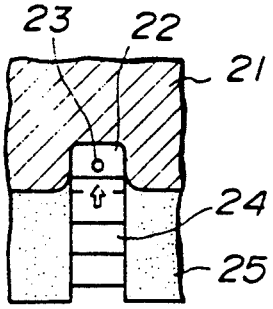
FIG. 1B PRIOR ART
FIG. 1B shows an enlarged view of the part of the conventional ink jet head which is energized.
Figure 3:
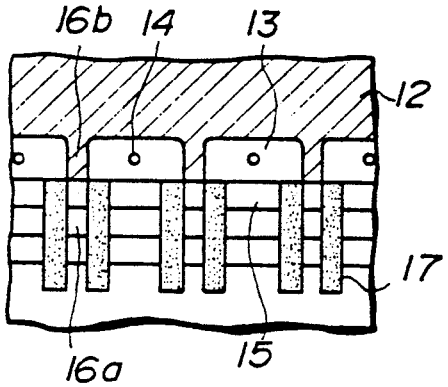
FIG. 3 shows a sectional view of an ink jet head of a first embodiment according to the present invention.

An ink jet head of a first embodiment according to the present invention, which corresponds to part I shown in FIG. 2, comprises, as shown in FIG. 3, a passage plate 12, a plurality of passages 13, a plurality of nozzles 14, a plurality of actuators 15, respective pluralities of diaphrams 16*a* and 16*b*, and stuffing material 17. The piezo-electric element is grooved so that each actuator 15 can be independently actuated. When each actuator 15 is energized, it flexes to press each of the respective passages 13 and jet ink via each of the nozzle 14. Since the diaphram 16*a* is connected with the diaphram 16*b*, the passage plate 12 can be prevented from being moved while the actuator 15 is actuated. Comparing the ink jet head shown in FIG. 3 with that shown in FIG. 1, even when the actuator 15 flexes, the passage plate 12 does not move upwardly since the grooves having stuffing material are not opposite to the passage plate 12 but instead opposite to the passage 13. Thus, according to the present invention, the flexure force of the actuator 15 can be sufficiently transmitted to the passage 13. That is, a ratio ($\Delta V/V_0$) between the volume ($V_0$) of the passage 13 and a change of the volume ($\Delta V$) responsive to a change of the length of the actuator 15 can be made larger. Incidentally, the piezo-electric element may have a single layer construction rather than a multilayer construction. The diaphram 16*a* may be partially located below the passage 13 only if the actuator 15 and the adjacent grooves are located below the passage 13.

Figure 4:
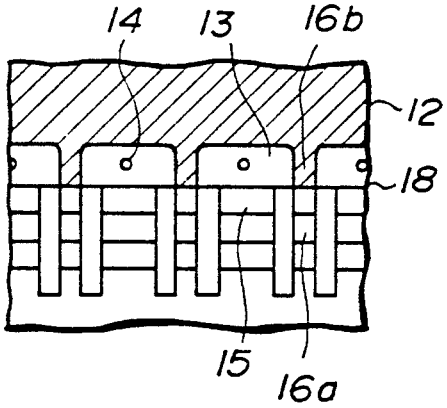
FIG. 4 shows a sectional view of an ink jet head of a second embodiment according to the present invention.

An ink jet head of a second embodiment according to the present invention, which corresponds to part I shown in FIG. 2, includes, as shown in FIG. 4, a film member 18. Those elements in FIG. 4 which are the same as corresponding elements in FIG. 3 are designated by the same reference numerals, and a description thereof will be omitted. The ink jet head shown in FIG. 4 can also enlarge the ratio $\Delta V/V_0$, like the ink jet head shown in FIG. 3. The film member 18, held by the diaphrams 16*a* and 16*b*, serves to passivate internal electrodes. In addition, the stuffing material 17 shown in FIG. 3 is not needed in this embodiment since the film member 18 encloses the grooves in the piezo-electric element.

Figure 5:
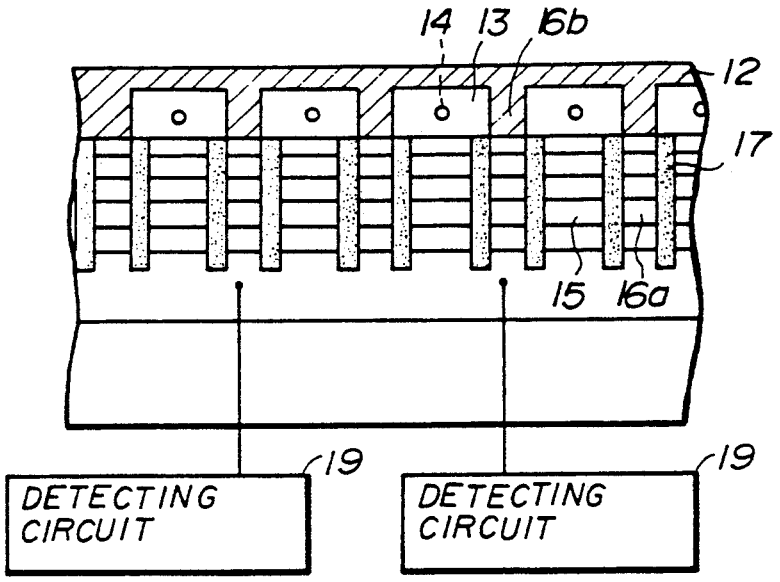
FIG. 5 shows a sectional view of an ink jet head of a third embodiment according to the present invention.
Figure 6:
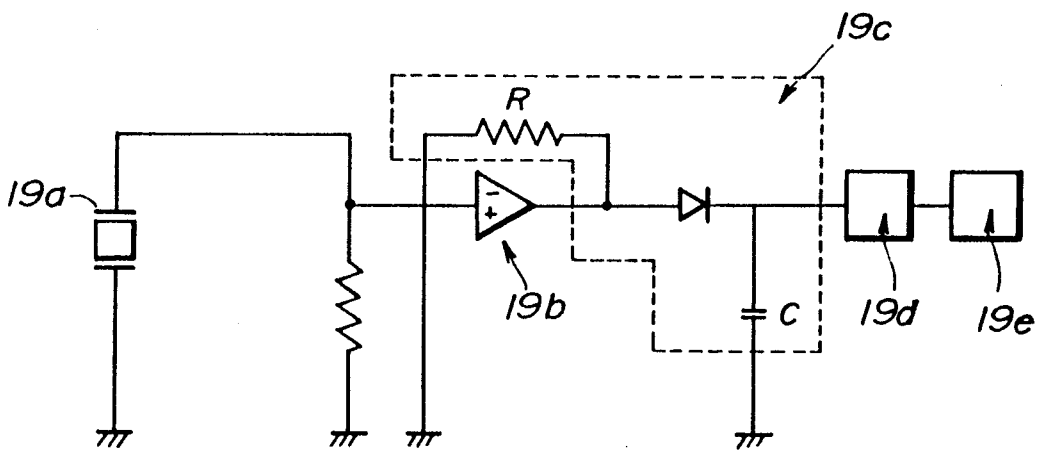
FIG. 6 shows a circuitry construction of a detecting circuit of the ink jet head shown in FIG. 5.

An ink jet head of a third embodiment according to the present invention, which corresponds to part I shown in FIG. 2, includes, as shown in FIG. 5, a plurality of detecting circuits 19. Those elements in FIG. 5 which are the same as corresponding elements in FIGS. 3 and 4 are designated by the same reference numerals, and a description thereof will be omitted. In this embodiment, a plurality of detecting circuits 19, each of which comprises as shown in FIG. 6, are provided at the diaphram 16*a*, which is a non-driven part in the piezo-electric element. In FIG. 6, an output of a diaphram piezo-electric ceramics 19*a* is amplified by an amplifier 19*b*, direct-current converted by an integral circuit 19*c* having a time constant CR, and input to a level comparator 19*d*. The level comparator 19*d* detects the existence of a bubble by comparing an output voltage with a reference voltage. If the level comparator 19*d* detects a bubble, a central processing unit (CPU) 19*e* executes a bubble removal process in which printing is stopped and bubbles are removed via a pump or vacuum (not shown).

Figure 7A:
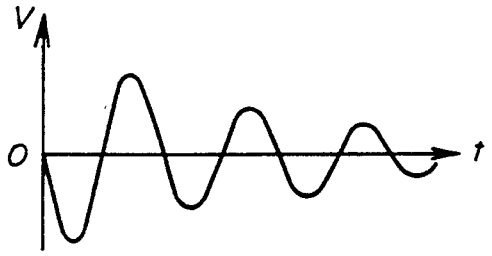
FIGS. 7A and 7B respectively show views for explaining the operation of the ink jet head shown in FIG. 5.
Figure 7B:
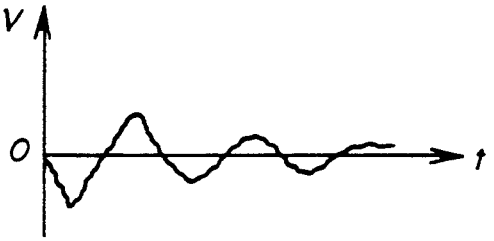

The pressure in the passage 12 increases when voltage is applied to the actuator 15, and ink is jetted from the nozzle 14 to record something on a recording paper. FIG. 7A shows a voltage output detected by the detecting circuit 19 when bubbles do not exist in the passage 13. FIG. 7B shows a voltage output detected by the detecting circuit 19 when bubbles exist in the passage 13. Without bubbles, the pressure in the passage 13 sharply rises as voltage applied to the actuator 15 and the diaphram 16*a* is heaved via the diaphrams 16*b*, as shown in FIG. 7A. With bubbles, the pressure in the passage 13 does not sharply rise, as shown in FIG. 7B. Since the detecting circuit 19 is not affected by the driving voltage applied to the actuator 15, it can detect the change in the flexure of the actuator 15. The difference between the voltage waves is easily detected, in the form of bubbles, by comparing the voltage output value with a reference voltage value. One detecting circuit is provided for every other diaphram 16*a*, as shown in FIG. 5, since it simultaneously detects the pressures in two passages 13. Thus, a number of the detecting circuits in the ink jet head according to the present embodiment is half a number of the detecting circuits in the conventional ink jet head. In addition, the circuitry construction of the ink jet head according to the present invention is relatively simpler.

Figure 8:
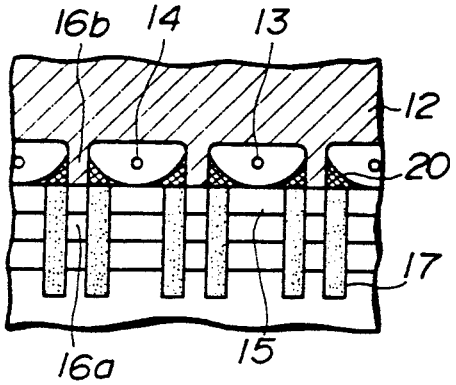
FIGS. 8 and 9 respectively show sectional views for explaining the operation of an ink jet head of a fourth embodiment according to the present invention.
Figure 9:
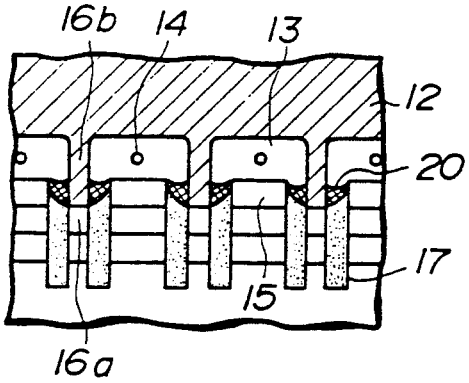

When the diaphrams 16*a* and 16*b* shown in FIG. 3 are bonded to each other, binding material 20 often overflows out of a junction part and comes into contact with the actuator 15, as shown in FIG. 8. Since the diaphrams 16*a* and 16*b* are forced via tightened binding material when the actuators 15 is actuated, the interference cannot be sufficiently reduced. According to the fourth embodiment, as shown in FIG. 9, the diaphram 16*a* is made shorter than the actuator 15. Thus, a junction surface between the diaphrams 16*a* and 16*b* becomes concave enough to store the overflowed binding material 20 therein. Consequently, the binding material 20 is in contact with the diaphrams 16*a* but not in contact with the actuator 15, so that the interference can be sufficiently reduced.

Further, the present invention is not limited to these preferred embodiments, and various variations and modifications may be made without departing from the scope of the present invention.

What is claimed is:

1. An ink jet head comprising:

a piezo-electric element including a plurality of actuators, first diaphrams, and first grooves, the actuators and the first diaphrams being convex parts of said piezo-electric element;

a passage plate including a plurality of second diaphrams and second grooves, the second diaphrams being convex parts of said passage plate and connected to the first diaphrams, and a source for ink supplied to each of said second grooves;

stuffing material, with which each of the first grooves of said piezo-electric element is filled, each of the second grooves being opposite to one actuator and two of said first grooves, said two first grooves being located at opposite sides of said one actuator;

a plurality of nozzles, one of which is attached to a corresponding one of the second grooves; and energizing means for energizing the actuators of said piezoelectric element, each of the actuators being flexed when energized by said energizing means so as to press a corresponding one of the second grooves and jet the ink therein through a corresponding one of said nozzles.

2. An ink jet head comprising:

a piezo-electric element including a plurality of actuators, first diaphrams, and first grooves, the actuators and the first diaphrams being convex parts of said piezo-electric element;

a passage plate including a plurality of second diaphrams and second grooves, the second diaphrams being convex parts of said passage plate and connected to the first diaphrams, and a source of ink supplied to each of said second grooves;

a film member, located between said piezo-electric element and said passage plate, each of the second grooves being directly opposite, across said film member, to one actuator and two of said first grooves, said two first grooves being located at opposite sides of said one actuator;

a plurality of nozzles, one of which is attached to a corresponding one of the second grooves; and energizing means for energizing the actuators of said piezoelectric element, each of the actuators of said piezoelectric element being flexed when energized by said energizing means so as to press a corresponding one of the second grooves through said film member and jet the ink therein through a corresponding one of said nozzles.

3. An ink jet head according to claim 1, wherein the first and second diaphrams are bonded to each other by binding material and each of the first diaphrams is shorter than each of the actuators.

4. An ink jet head according to claim 2, wherein the first and second diaphrams are bonded to each other by binding material and each of the first diaphrams is shorter than each of the actuators.

5. An ink jet head according to claim 1, further comprising a plurality of detecting circuits, each located near the first diaphrams, for detecting whether or not bubbles exist in each of the second grooves.

6. An ink jet head according to claim 2, further comprising a plurality of detecting circuits, each located near the first diaphrams, for detecting whether or not bubbles exist in each of the second grooves.

7. An ink jet head according to claim 1, wherein each one of the detecting circuits corresponds to two of said first diaphrams.

8. An ink jet head according to claim 2, wherein each one of the detecting circuits corresponds to two of said first diaphrams.

* * * * *